United States Patent [19]

Lewis, Jr.

[11] Patent Number: 4,689,902

[45] Date of Patent: Sep. 1, 1987

[54] BREAKAWAY RIDING BOOT

[75] Inventor: Johnnie D. Lewis, Jr., Lubbock, Tex.

[73] Assignee: Anthony E. Deprima, Phoenix, Ariz.; a part interest

[21] Appl. No.: 883,162

[22] Filed: Jul. 8, 1986

Related U.S. Application Data

[63] Continuation-in-part of Ser. No. 678,001, Dec. 3, 1984.

[51] Int. Cl.[4] ..... A43B 5/00; A43B 23/04; A43B 11/00

[52] U.S. Cl. ..... 36/131; 36/50; 36/105; 2/DIG. 6

[58] Field of Search ..... 36/50, 7.1 R, 7.3, 68, 36/131, 105; 2/DIG. 6

[56] References Cited

U.S. PATENT DOCUMENTS

| | | | |
|---|---|---|---|
| 301,333 | 7/1884 | Brown | 36/50 |
| 384,224 | 6/1888 | Yeagle | 36/50 |
| 400,421 | 3/1889 | Wynkoop | 36/50 |
| 401,007 | 4/1889 | Caspary | 36/50 |
| 1,165,874 | 12/1915 | Hale | 36/50 |
| 2,619,744 | 12/1952 | Mattes | 36/105 |
| 2,666,966 | 1/1954 | Odland | 36/50 |
| 2,680,310 | 6/1954 | Laird et al. | 36/50 |
| 2,986,824 | 6/1961 | Bingham, Jr. | 36/50 |
| 4,136,468 | 1/1979 | Munschy | 36/97 |
| 4,217,706 | 8/1980 | Vartanian | 36/50 |
| 4,300,294 | 11/1981 | Recken | 36/97 |
| 4,512,089 | 4/1985 | Carrier | 36/50 |
| 4,599,811 | 7/1986 | Rousseau | 36/105 |

FOREIGN PATENT DOCUMENTS

| | | | |
|---|---|---|---|
| 109484 | 12/1927 | Fed. Rep. of Germany | 36/68 |
| 2637277 | 2/1978 | Fed. Rep. of Germany | 36/92 |
| 20598 | of 1905 | United Kingdom | 36/50 |

*Primary Examiner*—Henry S. Jaudon
*Assistant Examiner*—Steven N. Meyers
*Attorney, Agent, or Firm*—Harvey B. Jacobson

[57] ABSTRACT

A riding boot has lengthwise pleats down the back secured together by Velcro fasteners. In the event a rider falls from a horse and the rider's foot is caught in a stirrup, the Velcro fasteners burst open allowing the pleats to unfold so that the rider's foot can be substantially instantaneously released from the boot thereby reducing the risk of injury.

11 Claims, 5 Drawing Figures

BREAKAWAY RIDING BOOT

CROSS REFERENCE TO RELATED APPLICATION

This application is a continuation-in-part of application Ser. No. 678,001, filed Dec. 3, 1984, the content of which is expressly incorporated herein by reference.

BACKGROUNND OF THE INVENTION

This invention relates to a form of boot for use by horse riders. Riders in general, and those taking part in equestrian sports in particular, are in frequent danger of being thrown from their mount. The risk of bodily injury in falling from a horse is in itself rather high, and is increased by the possibility of a rider's boot becoming stuck or hung in a stirrup in the course of a fall. Such occurrences frequently result in severe injuries. The present invention provides a form of riding boot which is adapted to break open should the boot become stuck in a horse's stirrup in the event a rider falls from the horse, so as to allow rapid release of the rider's foot from the boot, thereby reducing the risk of rider injury from this cause.

STATEMENT OF PRIOR ART

Applicant is aware of the following U.S. patents pertaining to boot structures and the like. None of these, however, discloses a riding boot having the features of the present invention.

587,483
470,316
1,216,579
3,286,375
3,763,579
3,845,769
4,030,214
4,178,703

SUMMARY OF THE INVENTION

In accordance with the invention, a riding boot has a lengthwise opening down the back of the boot, and releasable fasteners, such as Velcro fasteners, disposed along marginal edges of the boot defining the opening for releasably holding said edges together during normal usage of the boot in a manner snugly retaining a wearer's foot, the fastening means being adapted to break open in response to forces created by a rider falling from a horse with the boot caught in a stirrup, so as to provide rapid release of the rider's foot from the boot.

The rear of the boot may, for example, be of a pleated construction with the longitudinal opening being defined between a pair of adjoining pleats which carry the respective fastener means, and an internal gusset joining the pleats. The boot may also have a substantially V-shaped internal rear heel edge which further facilitates rapid release of a rider's foot. The pleated structure may be formed by a lengthwise slit in a conventional form of boot, and a three-panel folded insert, the edges of which are sewn internally to the slit-defining edges of the boot, and the Velcro fasteners being sewn externally to said edges.

Stated in the alternative, the invention provides a riding boot having a leg-receiving portion which is longitudinally pleated from the top of the boot to the region of the ankle, with releasable fastening means for holding the pleats together during normal usage of the boot so as to retain a rider's foot therein, the fastening means being adapted to break open in the event the rider falls from a horse and the rider's foot is caught in a stirrup so as to expand the boot by opening the pleats, and provide substantially instantaneous release of the rider's foot from the boot.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 2:
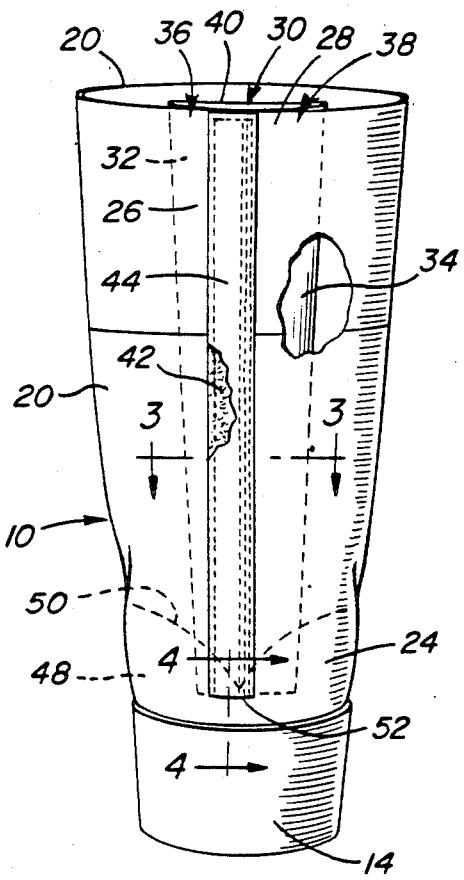
FIG. 2 is an enlarged rear elevational view of the boot.

4 is a sectional view on line 4—4 of FIG. 2.

Figure 5:
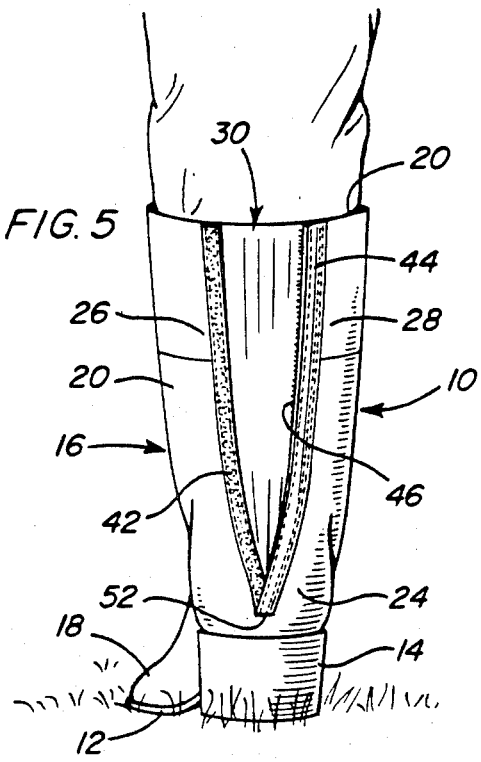

FIG. 5 is a rear elevational view of the boot in an open condition.

DESCRIPTION OF PREFERRED EMBODIMENT

Figure 1:
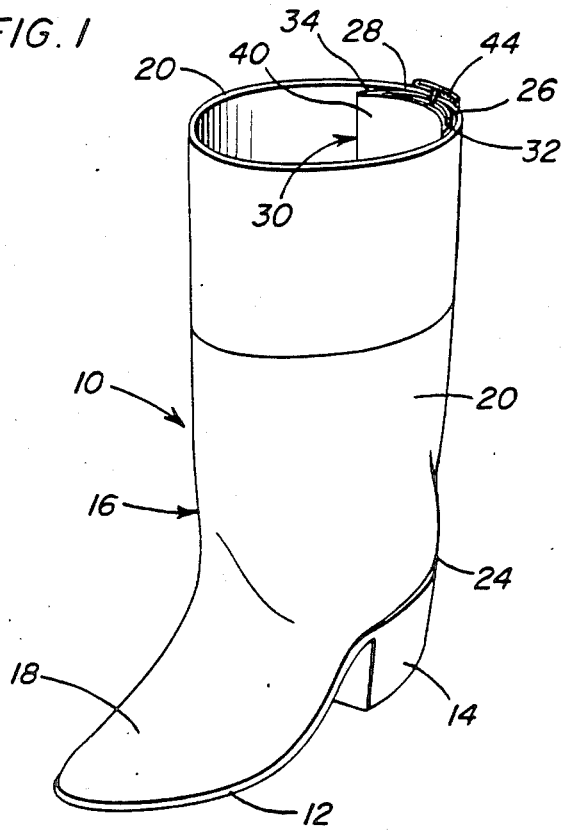
FIG. 1 is a perspective view of a riding boot in accordance with the invention.
Figure 3:
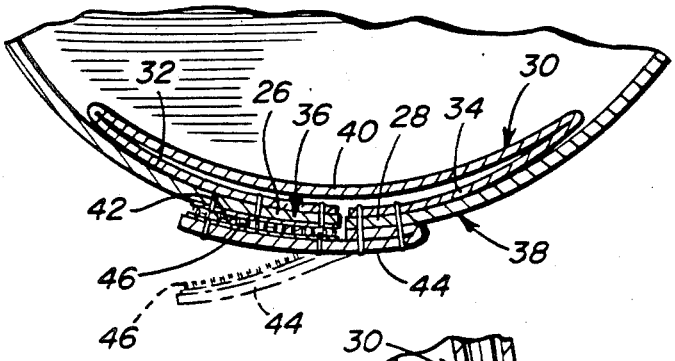
FIG. 3 is a further enlarged sectional view on line 3—3 of FIG. 2.
Figure 4:
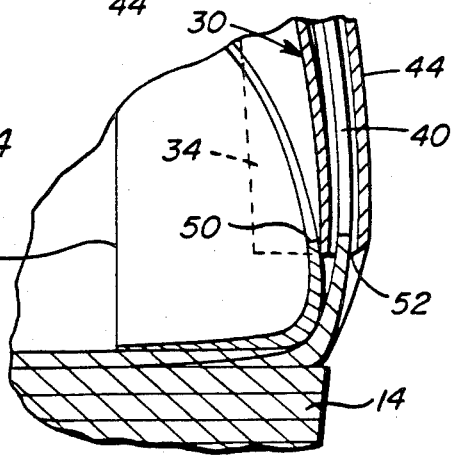

Referring in detail to the drawings, a riding boot 10 of generally conventional construction has a sole 12, a heel 14, and an upper 16 of leather or the like with a foot portion 18 and a lower leg portion 20. Leg portion 20 of the upper, which may extend up to about mid-calf, is longitudinally split down the back from the top of boot 22 to the heel area 24 with opposing edge portions 26, 28 of the upper defining the slit, see particularly FIG. 3. A three-panel folded insert 30, which may be of soft leather or the like, is located inside of the boot with edge portions of the outer panels 32, 34 of the insert being sewn to the corresponding edge portions 26, 28 of the upper respectively, so that the boot is provided with a pleated construction comprising adjoining pleats 36, 38 formed by the respective edge portions of the upper and the outer panels of the insert, and a gusset formed by central panel 40 of the insert connecting the pleats. The pleated construction allows the boot to expand from a closed condition shown in FIGS. 1 to 3, in which the boot is of conventional shape to snugly accommodate a rider's foot in normal usage, to an open condition shown in FIG. 5 by unfolding of insert 30 thereby opening up the pleats 36, 38. A first Velcro strip 42 is sewn along the outer edge of pleat 36, and a folded strip 44 with a second complementary Velcro strip 46 is sewn along the outer edge of pleat 38, so that the Velcro strips can be engaged to normally hold the boot in the closed condition.

Additionally, the boot is provided with a heel insert 48 which has a V or chevron-shaped upper edge 50 (as distinct from the straight upper edge normally provided on such inserts), the point of the V being located substantially at the base 52 of pleats 36, 38 as shown in FIG. 2, for example about a half inch above the insole of the boot.

In normal use of the boot for riding, Velcro strips 42, 46 hold the boot in the closed condition so that it fits in the manner of a conventional riding boot. Should the rider fall from a horse, however, and the rider's foot tend to get caught in the stirrup, the forces on leg portion 20 of the boot caused by the fall will cause the Velcro strips to burst open, thereby allowing the boot to expand by unfolding the pleats, so that the rider's foot can be substantially instantaneously released from the boot, reducing the risk of injury. Quick release of the foot is added by the chevron-shaped heel insert 48. The boot can be closed up again by means of the Velcro strips, and the expansion facility of the boot may also aid in putting it on.

With the point of the V of the heel insert being located about a half inch above the insole of the boot, in normal usage of the boot during walking or in normal riding conditions, the boot functions in a manner alike to a normal riding boot insofar as it snugly retains the user's heel while allowing a degree of up-and-down movement of the heel. However, should, for example, the user's foot become trapped or hung in a stirrup in the event of a fall, the user's heel moves above the point of the V (the hang point of the boot) and exerts outward pressure on the Velcro strips sufficient to burst the boot open. It is understood that with a normal boot which does not burst open under such pressure from the user's heel, the foot remains trapped in the boot leading to possible injuries. However, by the bursting open action above described, the user's foot can readily be released from the boot and from the stirrup. It is found in practice that to provide sufficient strength for normal use of the boot, while allowing a ready breaking away action as described above, the width of of the hook section of the Velcro strips preferably should be about $\frac{2}{3}$ inch.

While in the illustrated embodiment, the heel insert is described as having a top edge which has a V or chevron-shape, similar downwardly converging shapes can also be used.

In modifications of the invention, the pleated structure can be provided by means other than a slit in the upper and a folded insert such as insert 40. Further, the slit-type upper construction may be used per se with Velcro strips or the like but without an insert which forms pleats.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A riding boot comprising a sole, a heel, and an upper defining a foot-receiving portion and a lower leg-receiving portion, wherein the lower leg-receiving portion of the upper has a lengthwise opening extending down the back of the boot from the top of the boot to the heel of the boot, and fastening means for releasably holding opposing edges of the upper defining the opening together during normal usage of the boot, and for breaking open in response to forces created in the boot if the wearer of the boot falls from a horse and the wearer's foot is caught in a stirrup so as to provide quick release of the wearer's foot from the boot, wherein the boot includes a heel insert having an upper edge which diverges downwardly toward its center and defines a central tip located substantially at the base of the lengthwise opening above an insole of the boot so as to allow a degree of up-and-down movement of the user's heel during normal walking while providing quick release of the fastening means in the event the user's heel rises above the tip and exerts outward pressure on the fastening means.

2. The invention of claim 1 wherein the leg receiving portion of the upper has a pleated construction including a pair of adjoining pleats defining said opening therebetween, a gusset between the pleats, and the fastening means being associated with the respective pleats.

3. The invention of claim 2 wherein the leg receiving portion of the upper has a lengthwise slit and the pleats are formed by a 3-panel folded insert having outer panels secured along their edges to the respective edges of the upper defining the slit, and a central, panel of the insert defining the gusset between the pleats.

4. The invention of claim 1 wherein the opening is defined by a lengthwise slit in the leg-receiving portion of the upper.

5. The invention of claim 1 wherein the fastening means comprises complementary Velcro strips on said opposite edges of the upper.

6. The invention of claim 5 wherein the Velcro strips have a width of about $\frac{2}{3}$ inch.

7. A riding boot having a leg-receiving portion which is longitudinally pleated in back from the top of the boot down to the heel, the boot including breakaway loop and pile fastening means for holding a pair of adjacent pleats together during normal usage of the boot so as to retain a rider's foot therein, and for breaking open in response to forces created in the boot in the event the rider falls from a horse and the rider's foot is caught in a stirrup so as to expand the boot by opening of the pleats and provide substantially instantaneous release of the rider's foot from the boot, wherein the boot includes a heel insert having an upper edge which diverges downwardly to a central tip located substantially at the base of the pleats about $\frac{1}{2}$ inch above an insole of the boot.

8. The invention as defined in claim 7 wherein the pleats are formed by a lengthwise slit in an upper of the boot and a 3-panel folded insert having its outer panel secured internally to respective edges of the upper defining the slit, and a central panel forming a gusset between the pleats.

9. The invention of claim 7 wherein the fastening means comprises complementary Velcro fastener strips on the respective pleats.

10. The invention of claim 9 wherein the Velcro fastener strips comprise a loop strip and a pile strip wherein the loop strip is about $\frac{2}{3}$ inch wide.

11. The invention of claim 9 wherein one of the pleats has a first Velcro strip secured longitudinally along its outer edge and the other pleat has a longitudinal strip of material extending from an edge thereof with a second longitudinal Velcro strip complementary to the first Velcro strip on the strip of material.

* * * * *